US006709195B2

(12) United States Patent
Piccoli et al.

(10) Patent No.: US 6,709,195 B2
(45) Date of Patent: Mar. 23, 2004

(54) MOVEABLE TAILPIECE FOR ATTACHMENT TO A CURB FORMING MACHINE FOR PRODUCING LOW CURB PROFILES

(75) Inventors: Mario Piccoli, London (CA); Nicola Piccoli, London (CA)

(73) Assignee: N. Piccoli Construction, London (CA)

( * ) Notice: Subject to any disclaimer, the term of this patent is extended or adjusted under 35 U.S.C. 154(b) by 24 days.

(21) Appl. No.: 09/964,360

(22) Filed: Sep. 28, 2001

(65) Prior Publication Data

US 2002/0039519 A1 Apr. 4, 2002

Related U.S. Application Data

(60) Provisional application No. 60/236,163, filed on Sep. 29, 2000.

(51) Int. Cl.[7] ..... E01C 19/52
(52) U.S. Cl. ..... 404/98
(58) Field of Search ..... 404/96, 97, 98, 404/72, 73, 90, 92, 93, 105, 106

(56) References Cited

U.S. PATENT DOCUMENTS

| | | | | |
|---|---|---|---|---|
| 3,362,308 A | | 1/1968 | Austin et al. | |
| 3,797,958 A | | 3/1974 | Lofaro | 404/98 |
| 3,864,858 A | * | 2/1975 | Rochfort | 404/98 |
| 3,915,583 A | | 10/1975 | Aparico | 404/98 |
| 3,936,211 A | | 2/1976 | Miller et al. | 404/104 |
| 4,013,375 A | | 3/1977 | Heaton | 404/98 |
| 4,266,917 A | | 5/1981 | Godbersen | 425/64 |
| 5,662,431 A | | 9/1997 | Colvard | 404/105 |
| 6,508,606 B1 | * | 1/2003 | James et al. | 404/98 |

FOREIGN PATENT DOCUMENTS

| | | |
|---|---|---|
| CA | 2043773 | 12/1992 |

* cited by examiner

*Primary Examiner*—Thomas B. Will
*Assistant Examiner*—Alexandra K. Pechold
(74) *Attorney, Agent, or Firm*—Marks & Clerk

(57) ABSTRACT

A moveable tailpiece for use in association with a slip form on a curb forming machine. The tailpiece is selectively rotatable from a parked position, away from the slip form, to an engaged position at the end of the slip form. The tailpiece has the profile corresponding to a lowered curb profile as required to form, for example, a driveway access or handicap ramps. Utilizing the tailpiece in a curb formation considerably reduces the amount of manual finishing work required to produce an acceptable curb.

14 Claims, 11 Drawing Sheets

MOVEABLE TAILPIECE FOR ATTACHMENT TO A CURB FORMING MACHINE FOR PRODUCING LOW CURB PROFILES

CROSS-REFERENCE TO RELATED APPLICATION

This application claims the benefit of U.S. Provisional Application No. 60/236,163 filed Sep. 29, 2000, incorporated by reference herein.

FIELD OF THE INVENTION

This invention relates to a curb forming apparatus, and more particularly to an attachment to the slip form of a curb forming apparatus to produce low curb profiles.

BACKGROUND OF THE INVENTION

Self-propelled curb forming machines are well known, and have been in use for several years. These machines typically form continuous curbs along newly constructed roads and the like by causing concrete in a plastic or flowable state to be molded by a slip form mounted on the machine as it is propelled along the road. The plastic concrete has sufficient strength to retain the contour given to it by the slip form. An example of such a curb forming machine is the Commander III manufactured by Gomaco Inc.

A slip form typically has the profile of the desired profile of the finished curb or finished curb and gutter. It is a common requirement of curb construction to accommodate ramps and driveways, particularly in residential areas. To this extent, several methods have been developed to form the low profile curb required by, for example, a driveway. The prior art discloses methods wherein a cut off plate is selectively placed in the slip form in order to adjust the height of the finished curb. An example of one such device is disclosed in U.S. Pat. No. 3,797,958 issued to Lofaro (the Lofaro patent). A second example is Canadian Patent 2,043,773 issued to Cerquozzi et al. (the Cerquozzi patent).

In the Lofaro patent, the cut off plate is pivotally connected to the rear end of the slip form so that it is lowered into place when a low profile curb is to be formed. The excess concrete that is separated by the cut off plate is discarded or reclaimed for reuse.

The Cerquozzi et al. patent uses a plate within the slip form, which is mechanically or hydraulically lowered into the slip form in order to reduce the height of the curb portion.

In both of these methods, the finished curb does not have a smooth finish and considerable manual effort is required in order to produce a smooth curb surface.

U.S. Pat. No. 5,662,431 issued to Colvard, provides a system wherein the slip form for a full curb is removed and a replacement slip form having a new low curb profile is installed. This replacement operation requires that the curb forming operation stop during the replacement, and the resulting transition between the different profiles in the curb results in poor finish, again requiring considerable manual activity to provide an acceptable finish.

Handwork with conventional systems requires that a skilled workman lay supporting lumber on both sides of the curb to support the curb during tooling. Next, a finisher floats and tools the transition from a high curb profile to a low curb profile and the entire dropped section. The concrete is then manually smoothed and finished. With a typical driveway requiring up to one half hour for manual finish, this is extremely time consuming and adds considerably to the total cost of the operation.

Therefore, there is needed a means to allow the formation of various curb profiles, eliminating the need for excess hand work.

SUMMARY OF THE INVENTION

The present invention alleviates the aforementioned limitations by providing an attachment, known herein as a moveable tailpiece, for a curb forming machine, which is selectively rotatable into place on the back of the slip form. Preferably, this is effected via a hydraulic cylinder operating on a sprocket combination. The tailpiece is shaped to the profile required by the low curb section, and because it is held firmly in place, provides a smooth finish to the concrete such that very little to no manual finishing is required.

Thus, according to one aspect, the invention provides a moveable tailpiece for a curb forming machine for producing low curb profiles. The curb forming machine comprises a slip form. The tailpiece is shaped for rotation within the slip form between a parked position wherein the tailpiece is not in contact with the curb to be formed and an engaged position wherein the tailpiece is in contact with the curb to be formed.

According to another aspect, the invention provides a method of producing a curb having a changeable profile. The method comprises the steps of positioning a moveable tailpiece of a curbmachine to an engaged position, wherein the tailpiece is in contact with the curb, the tailpiece having a profile corresponding with the modified profile of the drop curb to be produced, and propelling the curbmachine forward over the area where the curb is to be produced.

There is a significant advantage in using a moveable tailpiece attachment in a curb forming machine. The tailpiece provides considerable savings in time and resources in the production of lowered curbs for driveway access and handicap ramps and sidewalks, The moveable tailpiece also eliminates the need for floating and tooling dropped sections of curb. Since hand finishing is now only required at the transition between profiles, the moveable tailpiece results in considerable saving of labor.

Other aspects and advantages of embodiments of the invention will be readily apparent to those ordinarily skilled in the art upon a review of the following description.

BRIEF DESCRIPTION OF THE DRAWINGS

Embodiments of the invention will now be described in conjunction with the accompanying drawings, wherein.

This invention will now be described in detail with respect to certain specific representative embodiments thereof, the materials, apparatus and process steps being understood as examples that are intended to be illustrative only. In particular, the invention is not intended to be limited to the methods, materials, conditions, process parameters, apparatus and the like specifically recited herein.

DETAILED DESCRIPTION OF THE PREFERRED EMBODIMENTS

Figure 1:
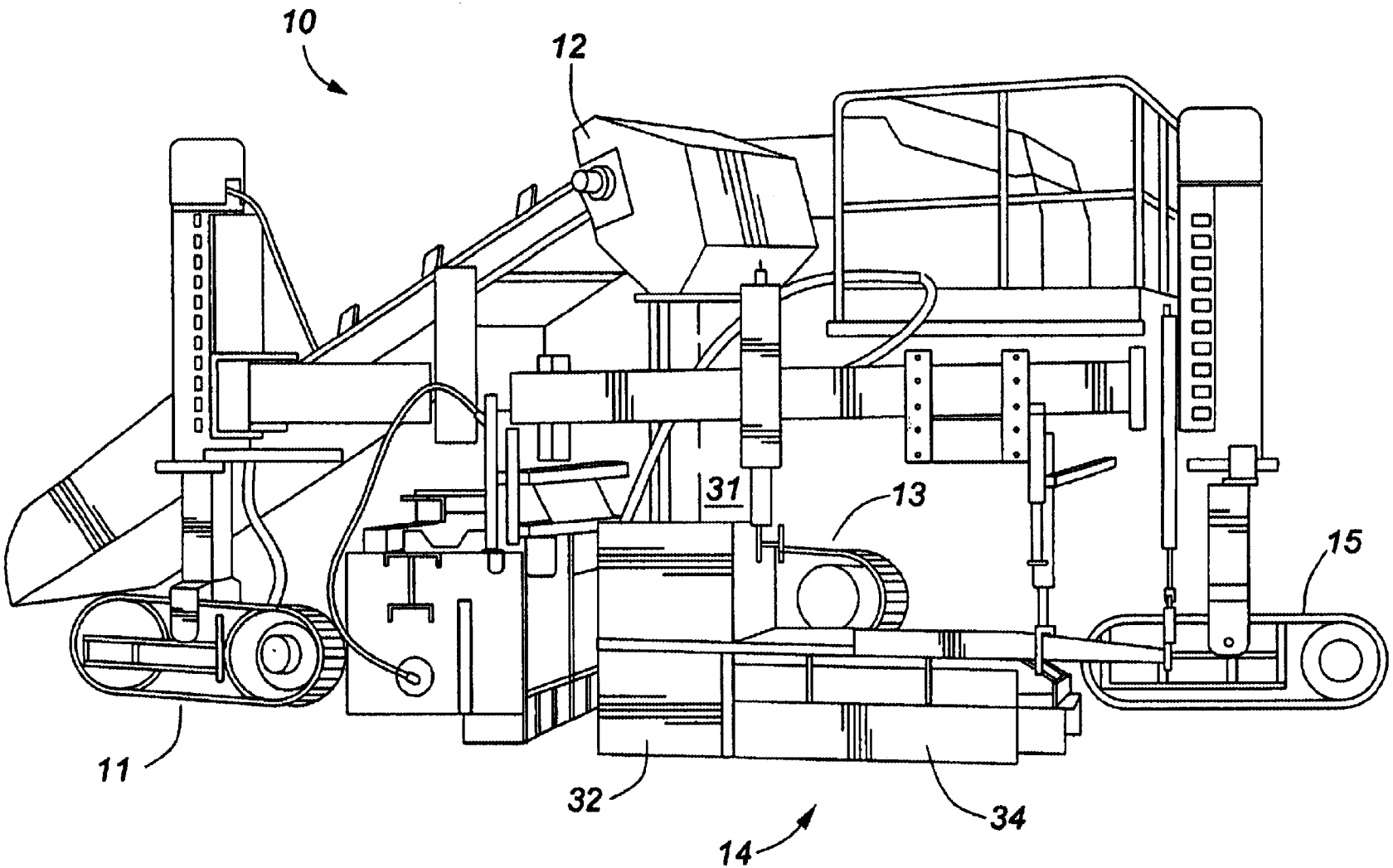
FIG. 1 is a perspective view of a curb forming machine.

FIG. 1 shows one example of a curb forming machine 10 such as the aforementioned Commander III by Gomaco Inc. It is to be understood, however, that the tailpiece described in this application will work on curb forming machines manufactured by other companies, provided there is sufficient clearance within the slip form for the tailpiece to be rotated into position, as is described below. Preferably, the tailpiece is mounted to the slipform with an axis of rotation about 1 ft or 30 cm from the top of the curb so that when it is rotated to a working position, the tailpiece is about 1 ft or 30 cm behind the slipform.

The curb forming machine 10 is intended to be self propelled by tracks 11, 13 and 15 so as to continuously form road side curbs and other formations involving the continuous pouring of concrete in a plastic state. The concrete is stored in a hopper 12 from which it is provided to the slip form mold 34 as discussed in the prior art.

Figure 2:
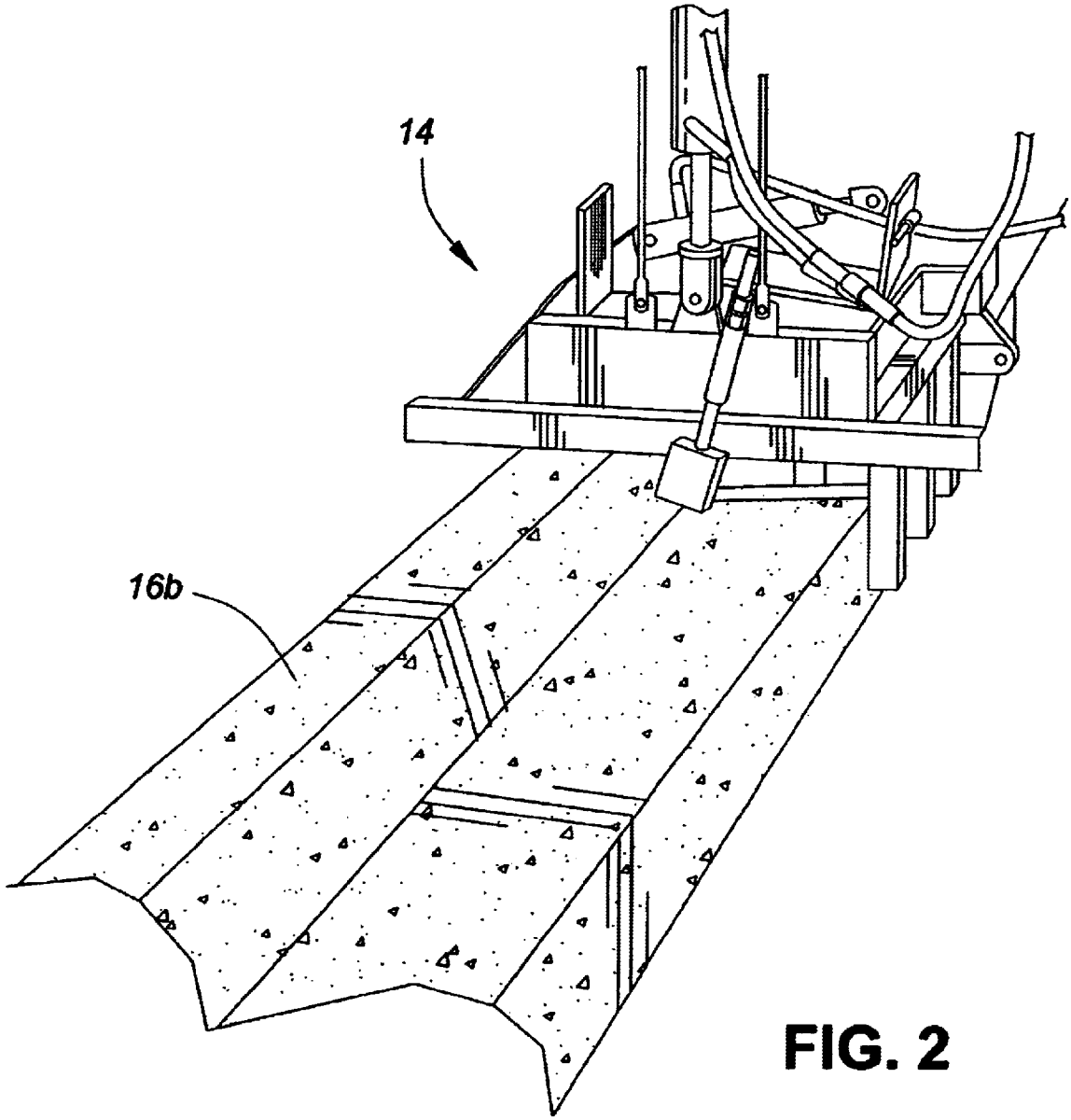
FIG. 2 shows the curb forming machine of FIG. 1 with a slip form producing the standard curb profile.
Figure 3:
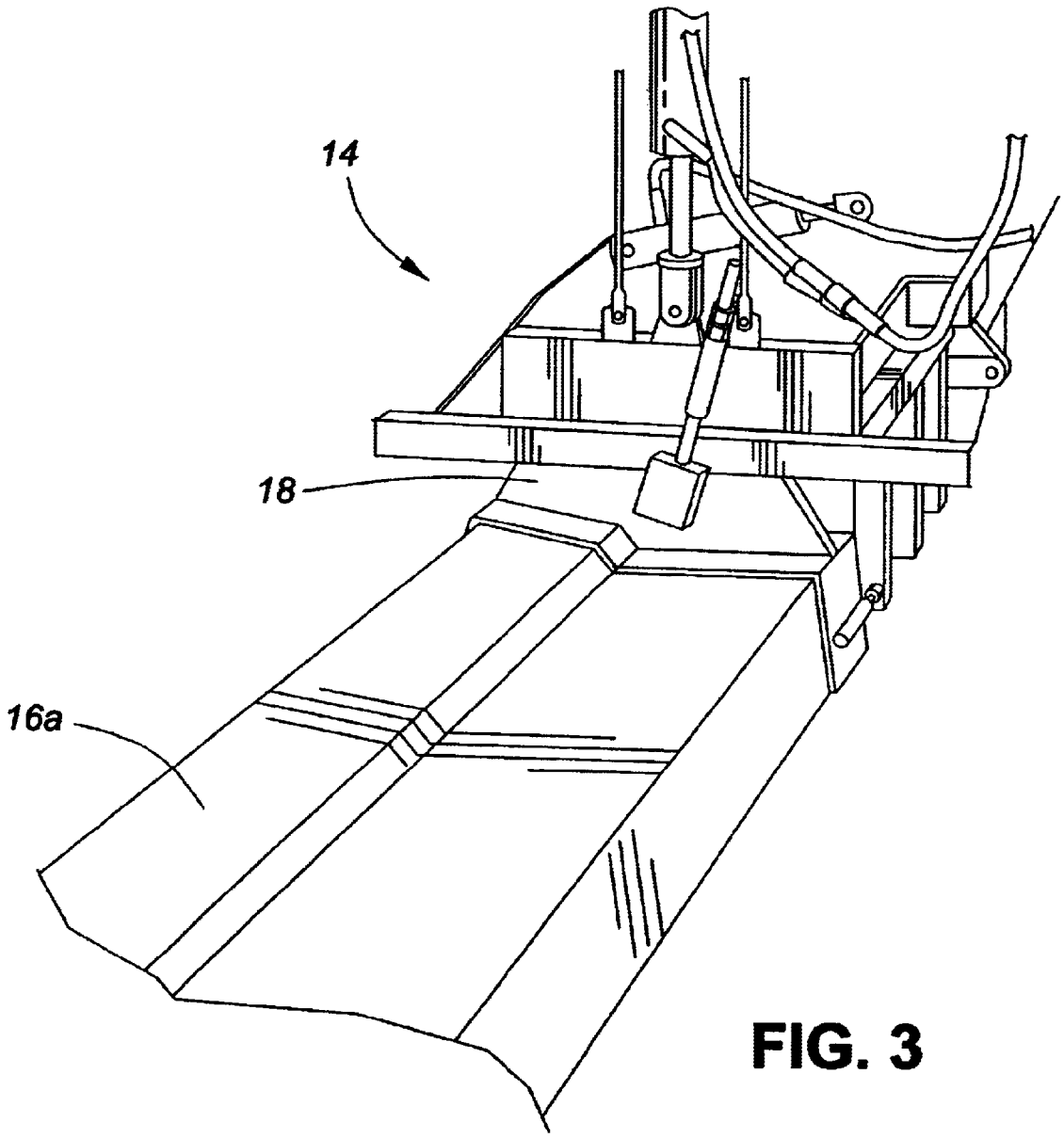
FIG. 3 shows the curb forming machine of FIG. 1 with the tailpiece in an engaged position, and forming a curb of a new profile.

FIG. 2 shows a profile of a high profile curb and gutter 16*b* as produced by a conventional slip form assembly 14. FIG. 3 illustrates the new, low curb profile 16*a* produced by the slip form after the tailpiece 18 of the present invention, as described below, has been lowered into position. It will be apparent that the profile of FIG. 3 is suitable for use as a driveway access and handicap ramps at sidewalks. It will also be apparent to one familiar with curb formation that the tailpiece 18 can be manufactured with different profiles as dictated by the curb profile required.

Figure 4:
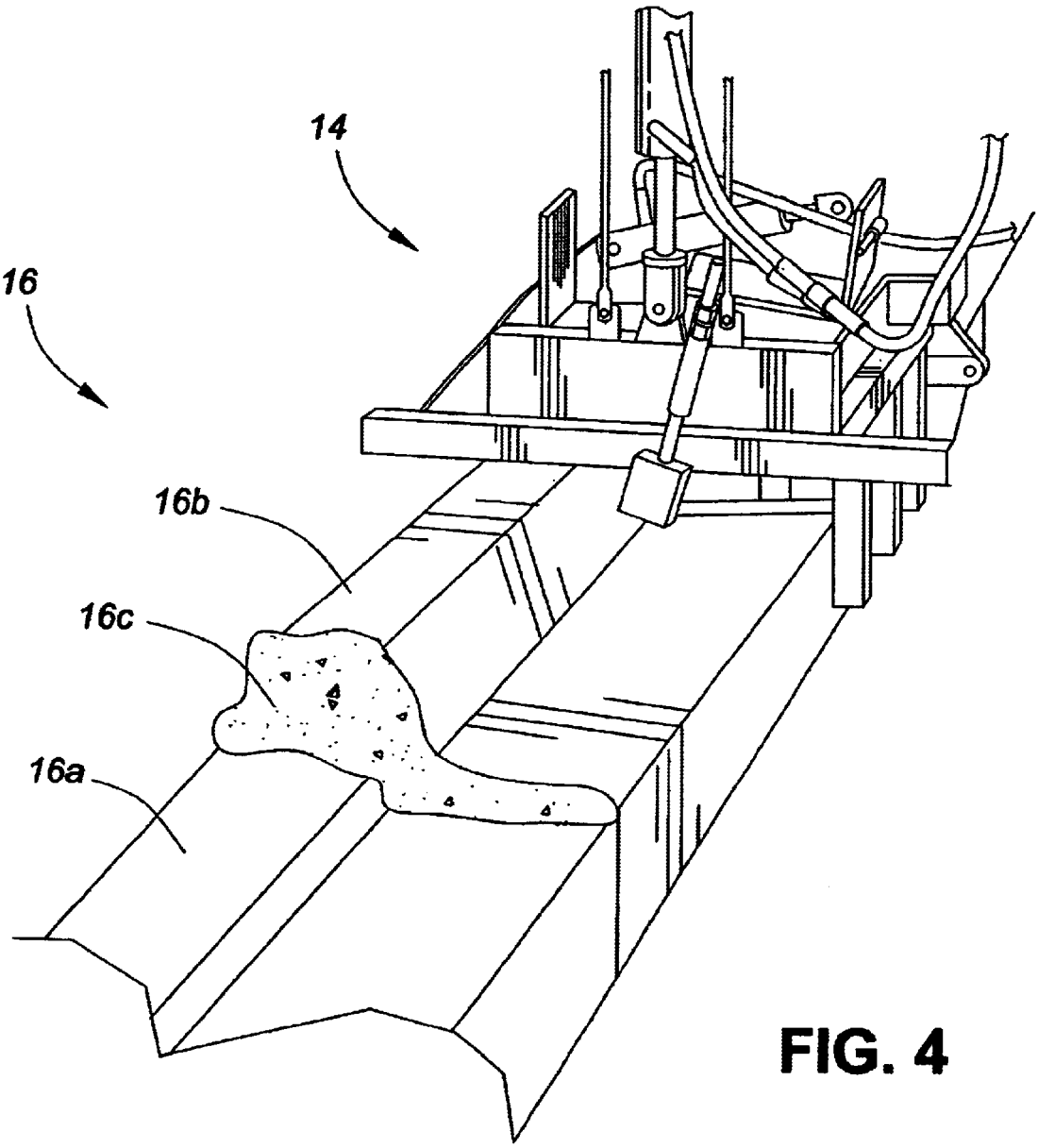
FIG. 4 shows a curb at the transition between the profiles of FIG. 2 and FIG. 3.

FIG. 4 illustrates the transition 16*c* between the low curb and gutter profile (dropped curb) 16*a* produced by the slip form with the tailpiece 18 and the high curb and gutter profile 16*b* produced by the standard slip form 34. It can be observed from FIG. 4 that if the finish of both the low profile 16*a* and high profile 16*b* curb and gutters is very similar, only minimal handwork at the transition 16*c* will be required to produce a finished product. The slip form is best seen in FIGS. 5 to 8. The slip form 34 is supported by two lateral members 20, 22 and secured to two cross members 24, 26 creating the full slip form assembly 14. The complete slip form assembly 14 is suspended from the frame of the curb forming machine 10 at the front of the hopper (not shown) and by the hydraulic cylinder 28 and threaded rods 29. The cylinder 28 allows for a height and longitudinal angle adjustment and positive hold down of the slip form assembly 14. In use, concrete from the hopper 12 enters the transition section 32 of the slip form 34 via chute 31 (seen in FIG. 1) and onto the ground. The profile of the slip form 34 then shapes the concrete in the desired curb profile.

Figure 4A:
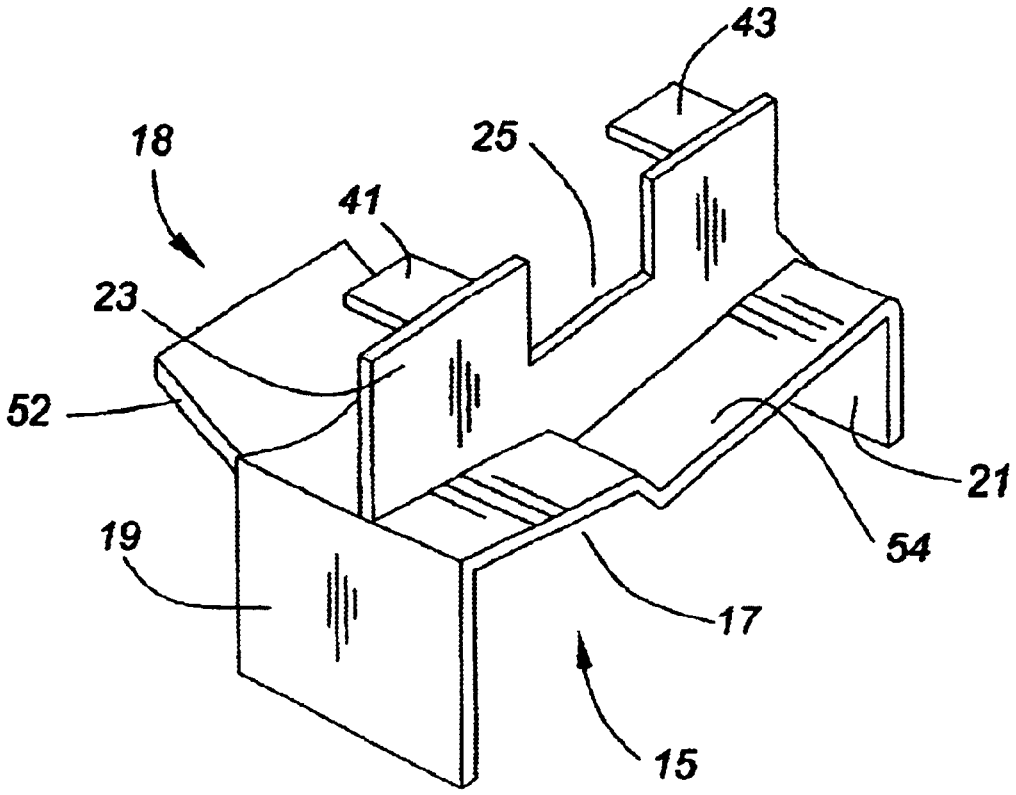
FIG. 4A illustrates the tailpiece of FIG. 3 in detail.
Figure 4B:
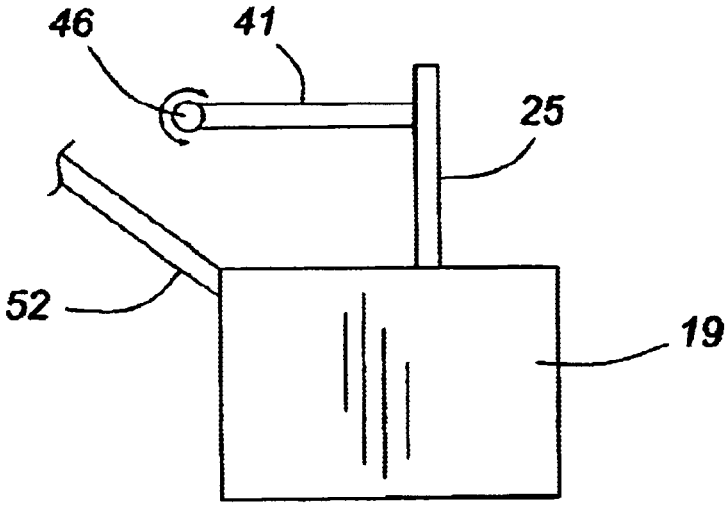
FIG. 4B illustrates a side view of the tailpiece of FIG. 3.

Referring to FIGS. 4A and 4B, the tailpiece 18 of the present invention is now described. The tailpiece 18 includes a profile 17 that contacts the concrete during use. Two side plates 19, 21 are on either side of the profile. The backplate 23 includes a slot 25 to provide clearance for the actuating bar 44. There is also a sloped extension plate 52 attached to the front of the tailpiece that fits up inside the high curb section of the slipform to ease the flow of concrete during slipforming of the drop curb portion of the work.

Figure 5:
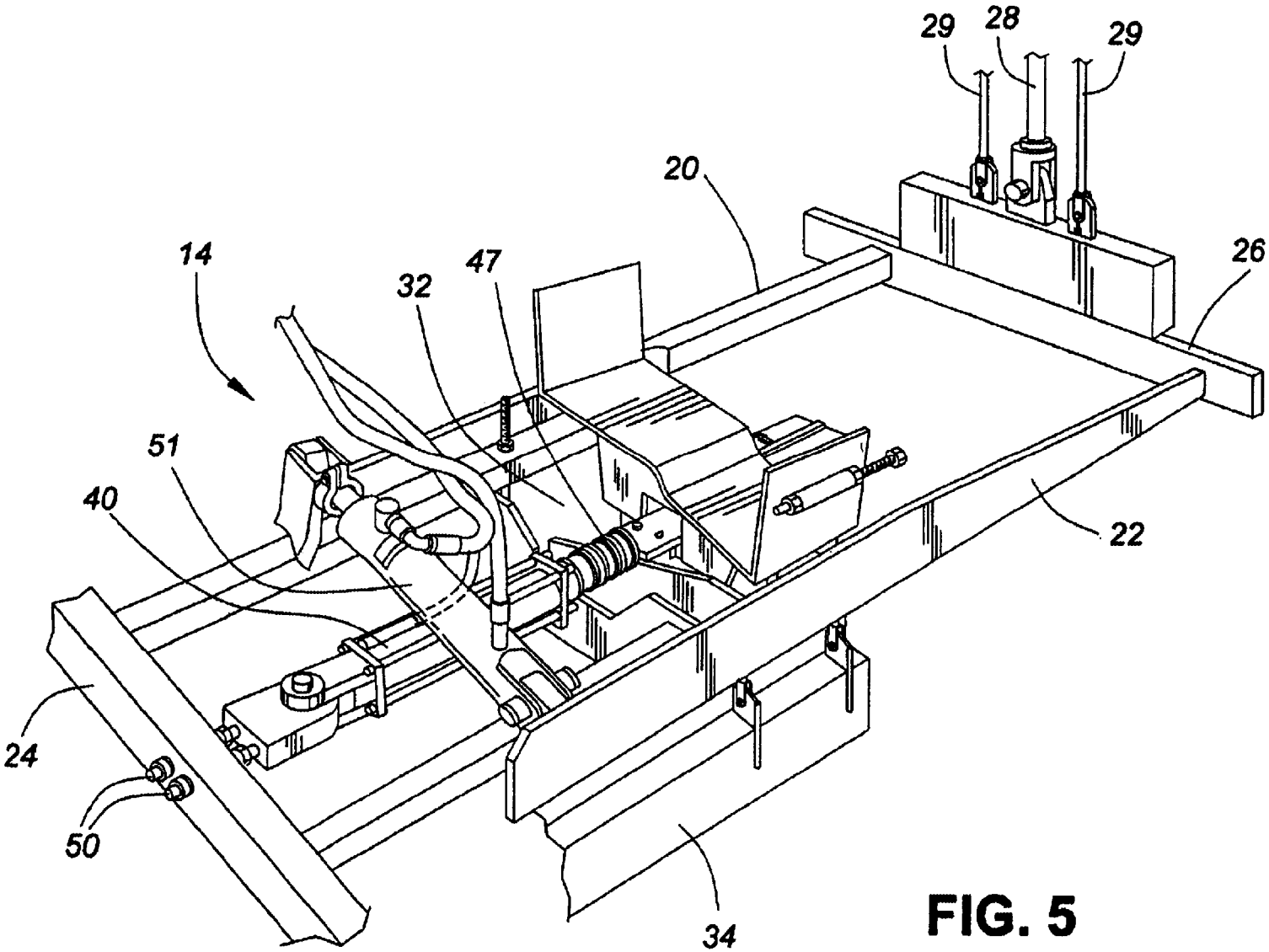
FIG. 5 is an enlarged view of the tailpiece of FIG. 3 in a parked condition.

FIG. 5 illustrates in an expanded view the tailpiece 18 in its parked position wherein the tailpiece 18 is not in contact with the curb 16 or the slip form 14. It can be observed that the profile 17 of the tailpiece 18 corresponds to the curb profile shown in FIG. 3 as required by a driveway access or handicap ramp at a sidewalk. Again, it is to be understood that this profile is selected for this particular application, but different profiles could be contemplated according to the application.

Figure 6:
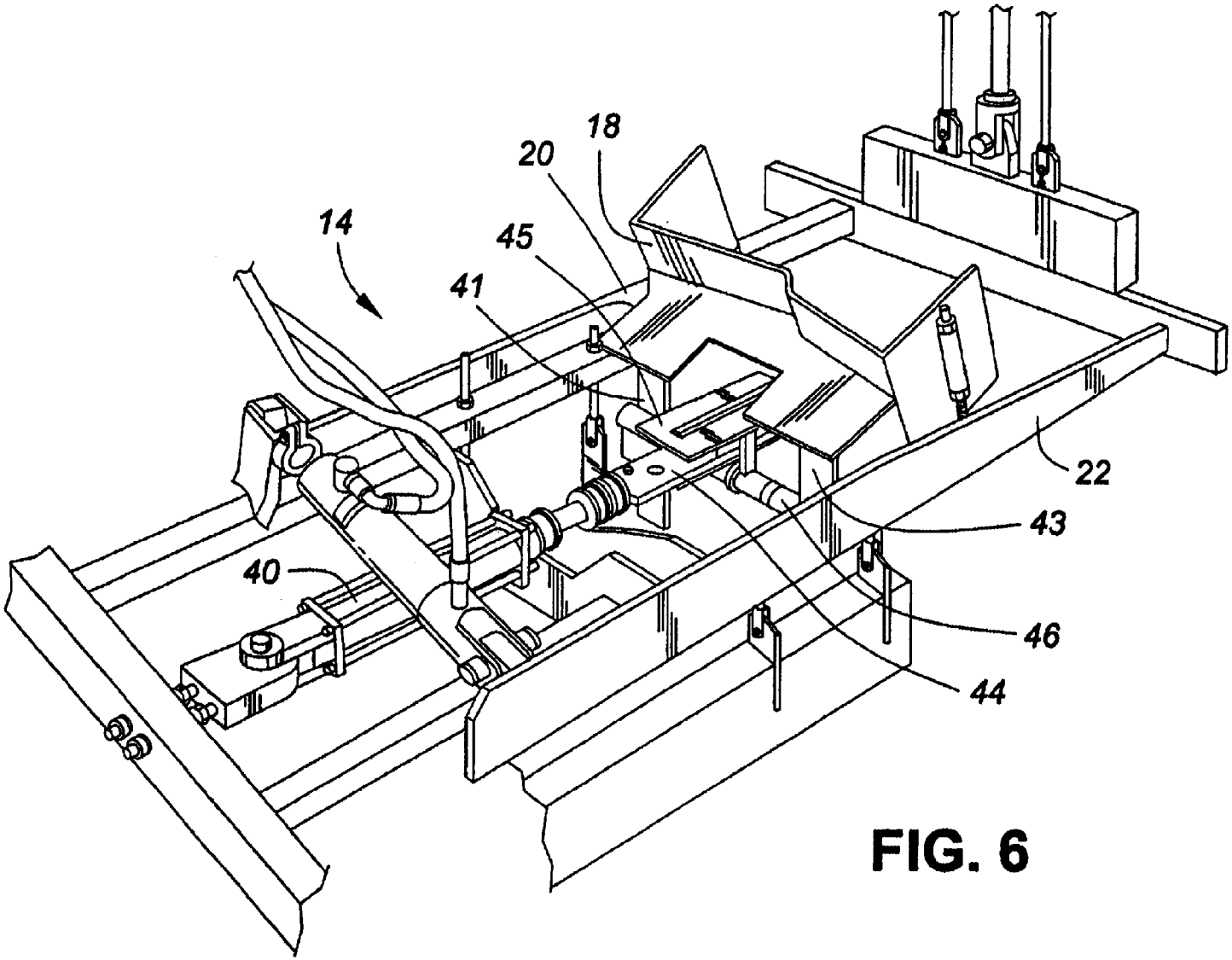
FIG. 6 shows the tailpiece of FIG. 3 partially rotated between a parked position and an engaged position.

FIG. 6 shows the tailpiece 18 in a partially rotated position between the parked position and the engaged position. As shown in FIG. 6, the rotation is brought about by activation of hydraulic cylinder 40 connected to the sprocket assembly 42, best seen in FIGS. 8 and 9. As the plate 44 attached to the hydraulic cylinder 40 is moved rearwardly, the sprocket assembly 42 rotates the lateral rod 46. The tailpiece 18 is mounted to the lateral rod by arms 41, 43 such that rotation of the lateral rod causes the tailpiece 18 to rotate from the parked position of FIG. 5 through the intermediate position shown in FIG. 6 to the engaged position shown in FIG. 7, wherein the tailpiece is in contact with the back edge of the slip form 14 and the curb and gutter 16. The plate 45 on top of the sprocket assembly 42 further prevents concrete from collecting in the slots of the sprockets 42.

Figure 7:
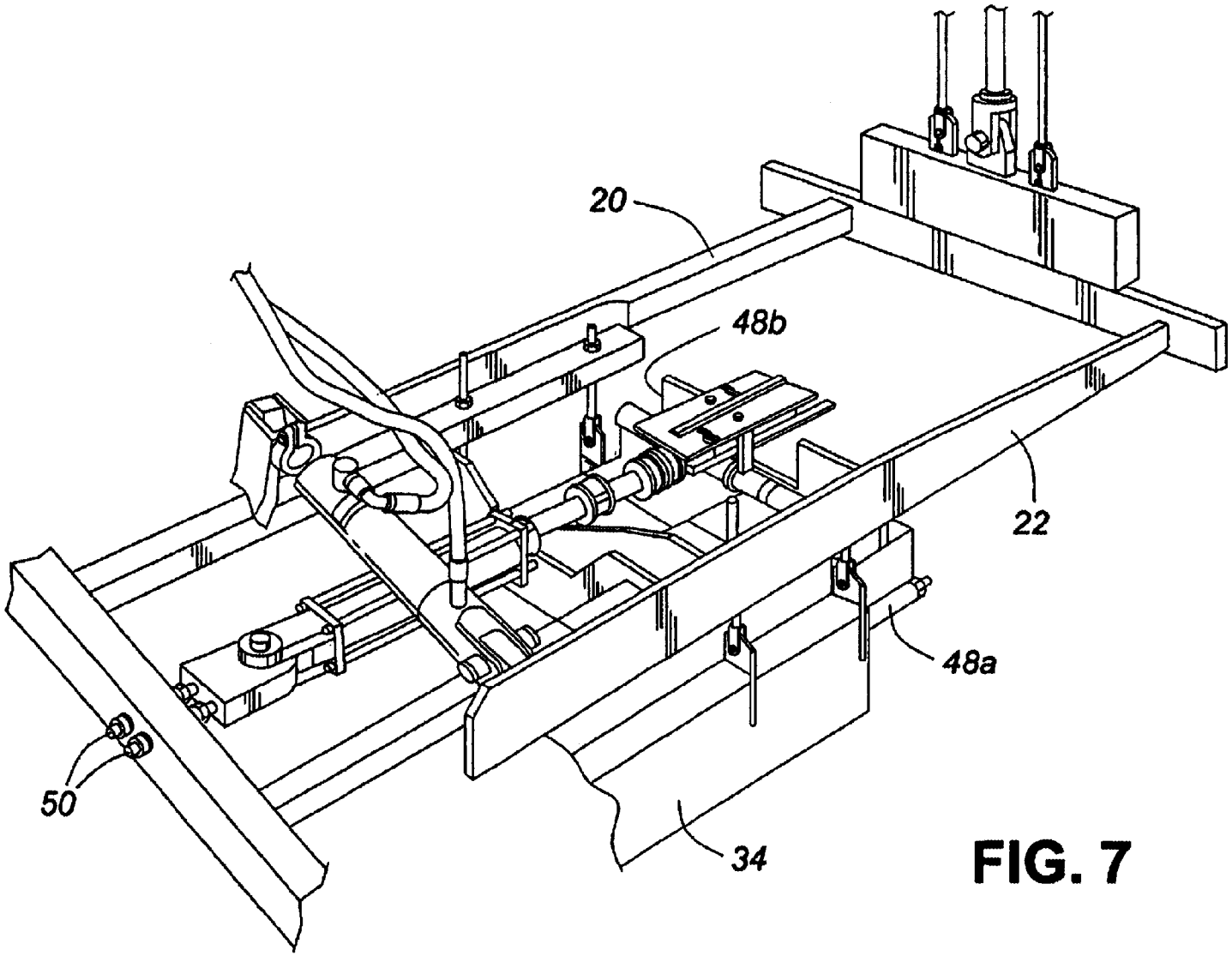
FIG. 7 shows the tailpiece of FIG. 3 in its engaged position on the slip form.
Figure 8:
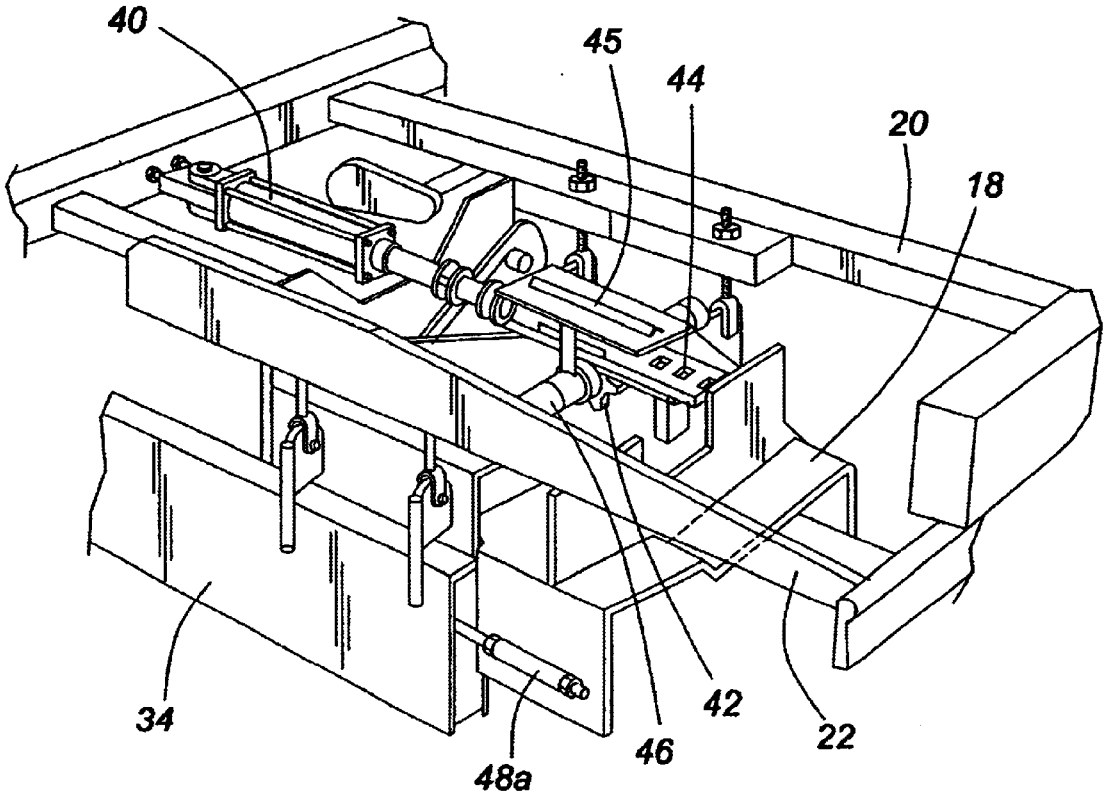
FIG. 8 is a side view of the tailpiece of FIG. 7.

FIG. 8 is a side view of the tailpiece 18. The threaded rod stops 48*a* and 48*b* on either side of the tailpiece, only one being visible in FIG. 8, are used to adjust the tailpiece 18 for proper finish when it is engaged as seen in FIGS. 3 and 7. This adjustment allows the tailpiece 18 to be positioned firmly against the slip form 14 and locked with constant pressure against the back edge of the slip form plate 34, so that the tailpiece 18 cannot be moved by the force of the concrete entering the slip form in the engaged position. There are also large adjustment bolts 50 best seen in FIG. 5, connected to the cylinder 40 to allow adjustment of the applied force on the tailpiece 18. The location of the full out extension of the cylinder 40 must be adjusted to ensure that only sufficient force is applied to hold the tailpiece 18 in place without causing damage to the remainder of the slipform.

Cylinder 40 is equipped with stop blocks 47 (best seen in FIG. 9) that prevent the cylinder 40 from over-rotating the tailpiece into the slipform. The cylinder 40 retracts, causing the tailpiece to move from its engaged position to its parked position, as described above. However, cylinder 40 has the ability to retract indefinitely, along with the tailpiece, until the tailpiece contacts the slipform, resulting in damage to the slipform. To prevent this, the stop blocks 47 are used to limit the shaft of the cylinder 40 from retracting too far back. In general, the more stop blocks added to the cylinder 40, the more limited the retractive stroke becomes. The blocks 47 are available in a variety of widths to allow the retractive stroke length to be finely adjusted.

Figure 10:
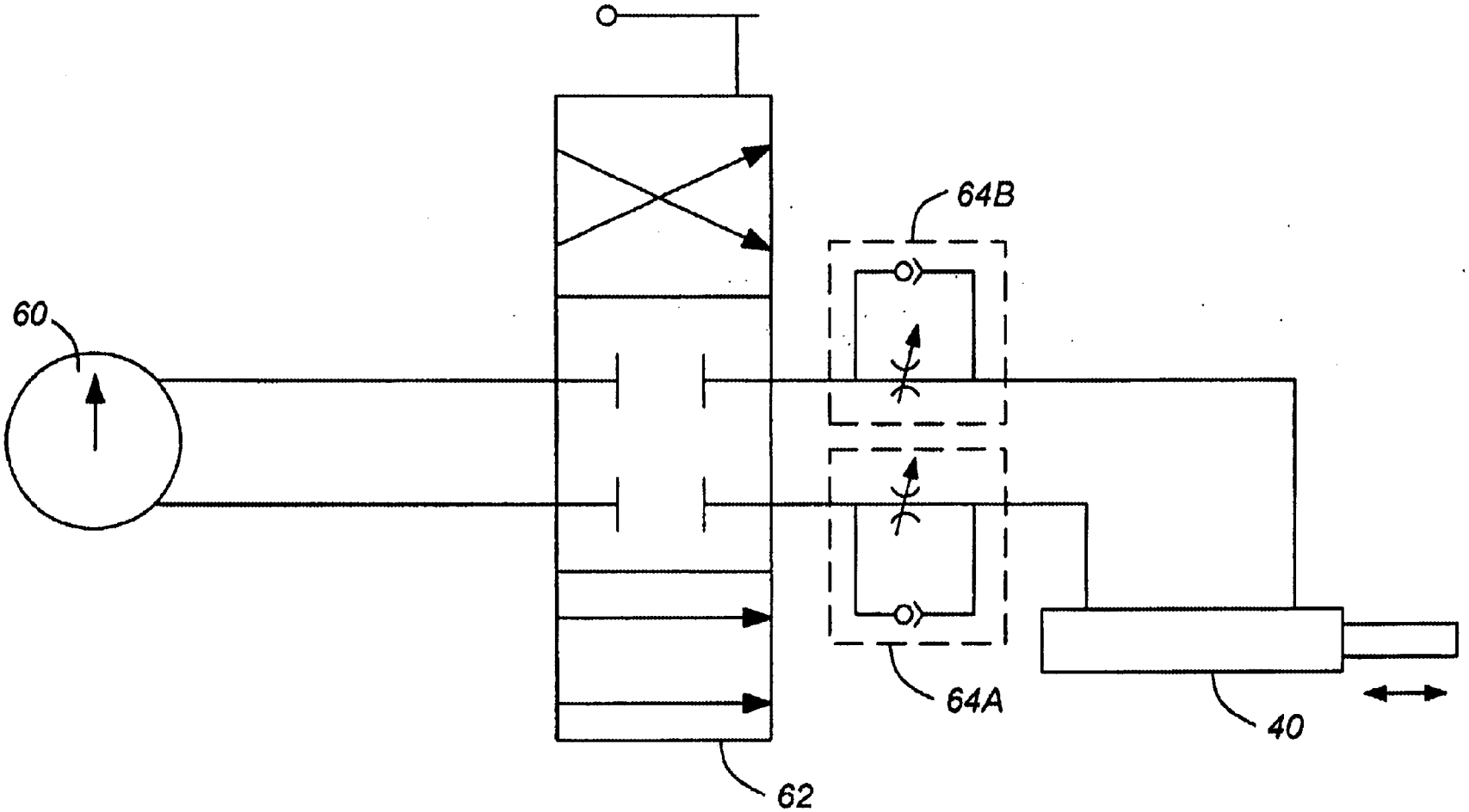
FIG. 10 illustrates the control circuit for the tailpiece of FIG. 3.

FIG. 10 illustrates the control circuit for the tailpiece actuator cylinder 40. The control circuit includes a pressure compensated variable displacement pump, which is a pump that will only pump when there is flow in the circuit. That is, if a valve opens, then the pump begins to pump. If the valve controls a cylinder and the cylinder tops or bottoms out, then the pump will stop pumping because there is no flow, but the pressure in the circuit will always be at maximum pressure.

Preferably, the pump operates at a pressure of 2200 psi when controlling cylinders.

The oil flow through the valve 62 controls the direction of the cylinder 40, to allow the tailpiece 18 to rotate between the parked and engaged positions.

The valve 62 has an indent in the handle (not shown) so that it locks when the tailpiece is in the engaged position. This ensures that full pressure on the tailpiece is engaged. Full pressure on the tailpiece 18 prevents the concrete from pushing the tailpiece 18 up, resulting in a poor finish. In the reverse position (ie: when the tailpiece is in the parked position), a locking indent is not needed since full pressure is not required to keep the tailpiece in its parked position. Therefore, the valve in this position could be spring-loaded, to ensure that the valve 62 returns to its neutral position after the tailpiece is parked.

Two needle valves 64A and 64B are added to the circuit to control the speed of the cylinder 40, and hence the tailpiece 18. A high flowing pump (~10–20 gpm) will cause the cylinder 40 move at high speeds, causing the tailpiece 18 to slam in both directions. The higher the pump flow, the faster the cylinder speed. The needle valves 64A and 64B create a smaller opening (which is preferably adjustable) for the oil to flow through, which reduces the flow of the oil and in turn reduces the speed of the cylinder 40.

The cylinder 40 is connected to the tailpiece 18 via a linkage as described earlier, which controls the movement of the tailpiece 18. When oil enters the back port, the rod of cylinder 40 extends, rotating the tailpiece 18 into the engaged position. When oil enters the front port, the rod of cylinder 40 retracts, rotating the tailpiece 18 back into its parked position.

Although a hydraulic cylinder 40 operating on a sprocket 42 combination is illustrated in the figures, it will be apparent to one skilled in the art that other ways of rotating the tailpiece 18 from a parked position to an engaged position and maintaining its position can be used. For example, the tailpiece 18 could be rotated into place manually and locked there by bolts or other fastening means. It is also contemplated that a hydraulically operated rotary actuator could be used.

Figure 9:
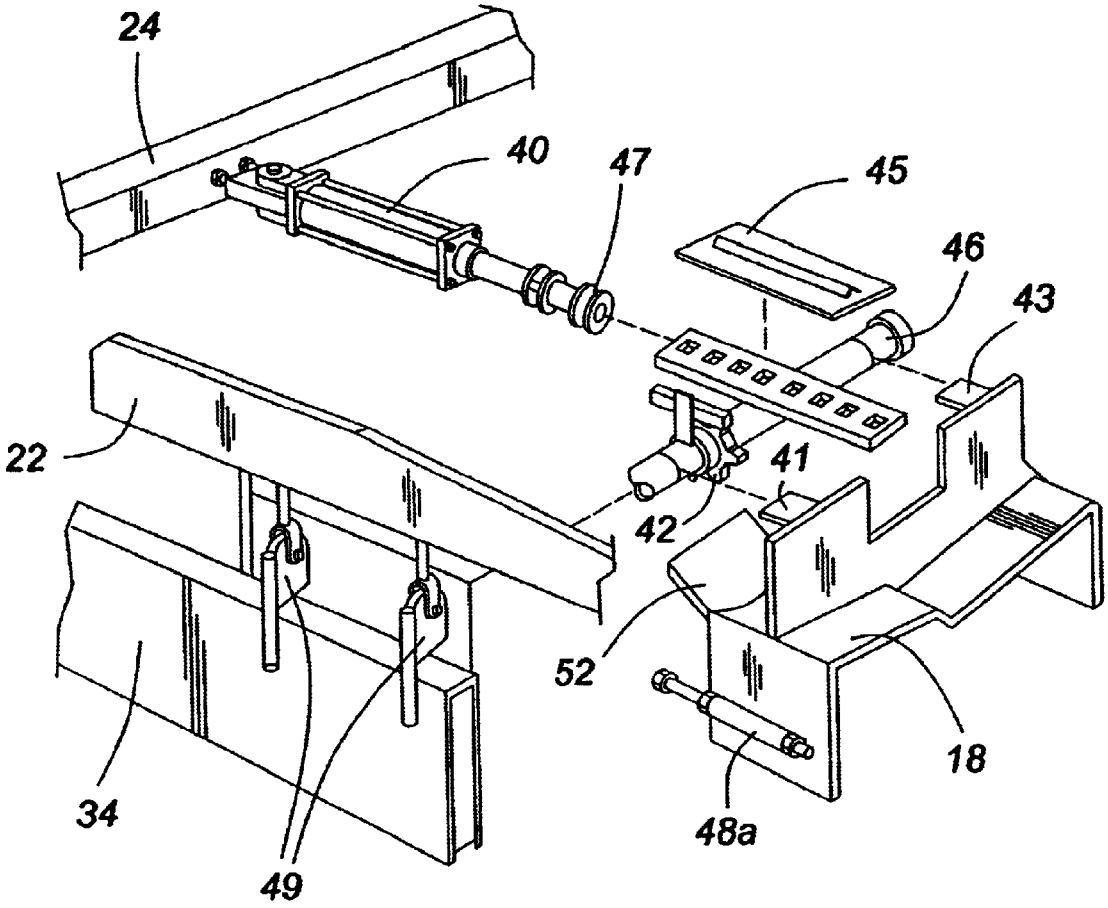
FIG. 9 is an exploded view illustrating the mounting of the tailpiece of FIG. 3 to the curb forming machine.

Referring to FIG. 9, in accordance with a preferred embodiment, hangers 49 are used to secure the slip form 34 to the lateral side members 20, 22. The tailpiece 18 is mounted on the conventional slip form 34 only via the lateral rod 46, which is rotatably mounted to the slip form 34 In this way, adjustment of the slip form does not require readjustment of the tailpiece.

As best seen in FIG. 4A, the tailpiece 18 has a sloped section 52 at the leading edge of the low profile portion 54 that co-operates with the factory supplied slip form 34 so that concrete flows smoothly into the tailpiece 18.

As mentioned above, the tailpiece can be factory made to any desired curb profile.

In operation, the tailpiece can be used alone or in conjunction with a cut-off plate. According to a preferred process, when a low profile section such as a driveway access is to be poured, the factory supplied cut-off plate is first used to lower the profile. Typically, a cut-off plate (not shown) is mounted on top of the slipform perpendicular to the frame rails 20, 22 and is controlled by cylinder 51, seen in FIG. 5. The cut-off plate is then engaged and the tailpiece 18 is rotated into engaged position, and used to further lower the profile. This procedure allows the height of the curb profile to be reduced prior to use of the tailpiece 18, resulting in a smoother finish. Alternately, the machine could be stopped at the point where a curb with reduced height is required and concrete removed manually to allow the tailpiece 18 to be rotated into place.

As noted above, the tailpiece 18 according to this invention provides considerable savings in time and resources in the production of a full curb and gutter and a lowered curb for driveway access and handicap ramps and sidewalks. The use of the tailpiece instead of a cutout plate or in conjunction with a cut-off plate as discussed above minimizes the amount of handwork required to achieve a smooth finish. The new tailpiece 18 also eliminates the need for floating and tooling dropped sections of curb formations. Therefore, since hand finishing is now only required at the transition between profiles, the new tailpiece results in considerable saving of labor.

While particular embodiments have been illustrated and described, it will be apparent to one skilled in the art that numerous changes can be made without departing from the intended spirit and scope of the invention as defined in the appended claims.

Numerous modifications may be made without departing from the spirit and scope of the invention as defined in the appended claims.

What is claimed is:

1. A method of continuously producing a curb having a changeable profile, the method comprising the steps of:

using a slip form within a curb forming machine to form a curb of a first profile;

rotating a moveable tailpiece within the slip form from a parked position wherein the tailpiece is not in contact with the curb to an engaged position wherein the tailpiece is in contact with the curb, the tailpiece having a profile corresponding with a modified profile of the curb to be produced; and propelling the curbmachine forward over the formed curb to form a curb of a second profile which is lower than the first profile.

2. The method of claim 1, further comprising the step of hydraulically locking the tailpiece in the engaged position.

3. The method of claim 1, wherein the tailpiece is shaped for rotation within the slip form of the curb forming machine between a parked position wherein the tailpiece is not in contact with the curb and the engaged position wherein the tailpiece is in contact with the curb.

4. The method of claim 1, wherein the tailpiece is hydraulically positioned between the parked and engaged position.

5. In a curb forming machine of the type having a frame, means to advance the frame forward, a hopper mounted to the frame for carrying concrete in a plastic state and a slip form for receiving the concrete from the hopper and forming a curb of a first profile from the concrete, a tailpiece mounted to the frame and shaped for rotation within the slip form between a parked position wherein the tailpiece is not in contact with the curb and an engaged position wherein the tailpiece is in contact with the curb for continuously forming a curb of a second profile, the second profile being lower than the first profile.

6. The tailpiece of claim 5, wherein the tailpiece is shaped in accordance with a desired curb profile to be formed.

7. The tailpiece of claim 6, wherein the tailpiece is hydraulically rotated between the parked position and the engaged position by means of a hydraulic cylinder.

8. The tailpiece of claim 7, wherein the hydraulic cylinder includes a stop block to limit the retractive stroke of the cylinder.

9. The tailpiece of claim 7, wherein threaded rod stops allow the application of a constant pressure against the slip form to hold the tailpiece in the engaged position.

10. A curb forming machine comprising: a frame; means to advance the frame forward; a hopper mounted to the frame for carrying concrete in a plastic state; a slip form for receiving the concrete from the hopper and forming a curb of a first profile from the concrete; and a tailpiece mounted to the frame and shaped for the rotation within the slip form between a parked position wherein the tailpiece is not in contact with the curb and an engaged position wherein the tailpiece is in contact with the curb for continuously forming a curb of a second profile, the second profile being lower than the first profile.

11. The machine of claim 10, wherein the tailpiece is shaped in accordance with a desired curb profile to be formed.

12. The machine of claim 11 further comprising a hydraulic cylinder to hydraulically rotate the tailpiece between the parked position and the engaged position.

13. The machine of claim 12, wherein the hydraulic cylinder includes a stop block to limit the retractive stroke of the cylinder.

14. The machine of claim 12, further comprising threaded rod stops allow the application of a constant pressure against the slip form to hold the tailpiece in the engaged position.

* * * * *